US011519632B2

(12) United States Patent
Burks, III

(10) Patent No.: US 11,519,632 B2
(45) Date of Patent: Dec. 6, 2022

(54) VARIABLE AIR FLOW / MULTIPLE ZONE HVAC AIR TERMINAL SYSTEM

(71) Applicant: Richard T. Burks, III, Lexington, KY (US)

(72) Inventor: Richard T. Burks, III, Lexington, KY (US)

( * ) Notice: Subject to any disclaimer, the term of this patent is extended or adjusted under 35 U.S.C. 154(b) by 0 days.

(21) Appl. No.: 17/503,225

(22) Filed: Oct. 15, 2021

(65) Prior Publication Data

US 2022/0120468 A1 Apr. 21, 2022

Related U.S. Application Data

(60) Provisional application No. 63/093,159, filed on Oct. 16, 2020.

(51) Int. Cl.

| | |
|---|---|
| ***F24F 13/10*** | (2006.01) |
| ***F24F 11/72*** | (2018.01) |
| ***F24F 11/62*** | (2018.01) |

(52) U.S. Cl.

CPC ..... *F24F 13/10* (2013.01); *F24F 11/62* (2018.01); *F24F 11/72* (2018.01)

(58) Field of Classification Search

CPC ..... F24F 13/02; F24F 13/0236; F24F 13/14; F24F 13/10; F24F 13/12; F24F 13/16; F24F 3/044

See application file for complete search history.

(56) References Cited

U.S. PATENT DOCUMENTS

| | | | | | |
|---|---|---|---|---|---|
| 3,921,900 | A * | 11/1975 | Cole | F16K 1/223 | 236/93 R |
| 4,142,574 | A * | 3/1979 | Shavit | F24F 11/30 | 165/230 |
| 4,210,278 | A * | 7/1980 | Obler | G05D 23/1931 | 236/440 |
| 4,662,269 | A * | 5/1987 | Tartaglino | F24F 3/044 | 236/46 R |

(Continued)

FOREIGN PATENT DOCUMENTS

CN 102022809 A 4/2011

OTHER PUBLICATIONS

"VVT System", The Severn Group (2019), printed from www.thesevergroup.com/vav-vs-vvt-havac-systems on Oct. 15, 2021.

*Primary Examiner* — Nelson J Nieves
(74) *Attorney, Agent, or Firm* — Nath, Goldberg & Meyer; Richard C. Litman

(57) ABSTRACT

A variable air flow/multiple zone HVAC air terminal system has a plurality of air passageways for conditioned air, bypass air, and optionally outside air, for separate distribution to outlet passageways to the multiple zones. A corresponding plurality of rotating cylindrical air dampeners selectively controls air flow from the conditioned air, bypass air, and outside air passageways to respective ones of the plurality of outlet air passageways corresponding to respective zones. Damper drivers cause rotation of the rotating air dampeners in response to sensed air conditions in the respective zones to control ratios and volume flow rates of the conditioned, bypass, and outside air fed to the respective outlet air passageways, so rotation of respective ones of the rotating air dampers selectively varies air flow to the respective outlet air passageways.

8 Claims, 5 Drawing Sheets

(56) References Cited

U.S. PATENT DOCUMENTS

| | | | | |
|---|---|---|---|---|
| 4,730,772 | A * | 3/1988 | Lortie | F24F 3/14 236/44 R |
| 5,931,227 | A * | 8/1999 | Graves | F24F 3/0442 165/216 |
| 6,029,698 | A * | 2/2000 | Murray | F24F 13/10 251/149.6 |
| 6,604,688 | B2 * | 8/2003 | Ganesh | F24F 3/1405 62/412 |
| 6,792,767 | B1 | 9/2004 | Pargeter et al. | |
| 6,880,359 | B2 * | 4/2005 | Pearson | F24F 13/10 62/186 |
| 7,059,400 | B2 | 6/2006 | Sekhar et al. | |
| 10,274,217 | B2 | 4/2019 | Gevelber | |
| 10,309,668 | B2 | 6/2019 | Song et al. | |
| 2002/0125333 | A1 * | 9/2002 | Ganesh | F24F 3/1405 62/186 |
| 2006/0130502 | A1 | 6/2006 | Wruck et al. | |
| 2010/0082162 | A1 * | 4/2010 | Mundy | F24F 3/044 700/277 |
| 2014/0260408 | A1 * | 9/2014 | Dempsey | F24F 3/0444 392/360 |
| 2017/0320370 | A1 * | 11/2017 | Aizawa | F24F 13/02 |
| 2018/0187915 | A1 * | 7/2018 | Nelson | F24F 13/20 |
| 2018/0274802 | A1 * | 9/2018 | Nishimura | F24F 13/02 |
| 2018/0274812 | A1 * | 9/2018 | Dorste | F24F 11/79 |
| 2018/0283705 | A1 * | 10/2018 | Handsaker | F24F 11/30 |
| 2019/0170375 | A1 * | 6/2019 | Poerschke | F24F 11/0001 |
| 2019/0277516 | A1 * | 9/2019 | Duncan | F24F 13/15 |
| 2019/0301768 | A1 | 10/2019 | Johnston | |
| 2020/0200448 | A1 * | 6/2020 | Ito | F24F 1/32 |

* cited by examiner

VARIABLE AIR FLOW / MULTIPLE ZONE HVAC AIR TERMINAL SYSTEM

CROSS-REFERENCE TO RELATED APPLICATION

This application claims the benefit of U.S. Provisional Patent Application No. 63/093,159 filed on Oct. 16, 2020.

BACKGROUND

1. Field

The present disclosure relates to HVAC systems, and particularly to a variable air flow/multiple zone HVAC air terminal system for regulating air flow in a variable air flow volume, multiple zone HVAC system.

2. Description of the Related Art

Forced air zoned air handling for climate control, including heating and cooling, is common in commercial applications. In addition, some of the features of zoned air handling are useful for residential applications. In a typical application, a heat exchanger and associated fan supply one or more zones. Many such systems are fixed volume systems.

In general, a constant air volume (CAV) HVAC system provides a constant airflow at a variable temperature, while a variable air flow volume (VAV) HVAC system provides a variable air flow at constant temperature to meet the rising or falling heat gains and losses within the zones being served. In a CAV system, the fan and compressor operate at full capacity until the temperature reaches a specified limit, and then the compressor modulates or shuts off. In a VAV system, the fan speed varies according to actual load demand and the temperature set point is maintained as the compressor modulates refrigerant flow to maintain a constant air supply temperature. In a multiple zone system, such as an office building with some offices having outside windows exposed to sunlight and some offices internal without window exposure, airflow volume is controlled to a particular zone by a VAV terminal unit (sometimes called a VAV box) that regulates airflow to different air terminals connected to the different zones for regulation of temperature and ventilation by outside air. The VAV terminal unit essentially functions as a calibrated air damper having an automatic actuator.

Ventilation control aspects of a heating, ventilation, and air conditioning (HVAC) system have become increasingly more important; driven by multiple factors. The recognition by the industry and building codes of the importance of providing an appropriate amount of ventilation air to the building occupants due to health considerations has increased. Concurrently, energy considerations create a drive to reduce energy consumed in conditioning the ventilation air.

In such systems, the fan accounts for a significant portion of the power consumption of the system, up to ⅓ of the average energy use in some systems. This is significant because full design air flow is not required at all times for all zones. Moreover, under some conditions, especially when a space is occupied, it is desired to maintain some degree of airflow and some degree of conditioning of the air. If each zone uses separate heating or chilling equipment, then such partial conditioning can consume significant energy. While some heating and chilling equipment, e.g., multiple inverter heat pump configurations, can operate efficiently at partial power, the energy savings is still limited.

In addition to temperature conditioning (heating/cooling), commercial buildings often are required to meet requirements for certain mandated heat recovery requirements for ventilation air, as well as airside or waterside economizer control strategies. This has narrowed system options, particularly for larger systems, which have become quite expensive to implement with the code-driven restraints. Similar needs are presented by a desire to maintain humidity within a preferred range in each zone.

The American Society of Heating, Refrigeration and Air Conditioning Engineers (ASHRAE), the International Mechanical Code (IMC), and the International Energy Conservation Code (IECC) set standards for HVAC in commercial buildings. Requirements include a minimum supply of outside air, which varies according to building occupancy. In some instances, building occupancy varies significantly according to time periods, which can be predictable or random. At times of low occupancy, the outside air requirements are significantly less than during times of high occupancy, so it is desirable to decrease the outside air ratio during times of low occupancy and increase the outside air ratio when the space has a high occupancy. Accordingly, during low occupancy, outside air is reduced to a minimum rate needed to exhaust such conditions as off gassing volatile organic compounds, but is increased when the room becomes crowded. Automated control of the outside/return air ratio can be accomplished in a number of ways, including occupancy sensors (useful in office space) to occupancy indicating gas or other occupancy indication sensors or other occupancy indicating gas or other sensors, which can be useful in spaces experiencing large fluctuations of use.

Different zones may have different requirements for temperature regulation and fresh air. For example, a room with high occupancy in a center area of the building may require significant amounts of fresh air, but may not require heat. If the system is designed with a single zone or a single point of adjustment for multiple zones, increased fresh air would be required for the entire adjusted area in order to accommodate fresh air requirements for the part of the building with high occupancy.

One of the issues with zoned systems is that the separate zones typically involve individual packaged HVAC terminal units, or at least separate indoor components (indoor coil, blower, etc.) This typically increases cost and complexity. Further, the ability to take advantage of the building's block load diversity and efficiency of larger variable rate compressors is limited because individual packaged units must be sized to operate at a peak load, even though the overall load is much less than peak.

Where the ventilation is introduced prior to the fan system component, building codes often stipulate that the ventilation portion of the supply air be set to meet the ventilation proportion required by the most demanding zone being served. This creates unnecessary ventilation demand on the HVAC system, most of the time during occupied periods.

These issues also affect economizer systems, which utilize lower temperature and admit fresh air for purposes of reducing the mechanical conditioning of the supply. Economizer systems respond to outside ventilation air temperature and humidity, as well as the operating set points for central cooling and heating plant operations.

Thus, a variable air flow/multiple zone HVAC air terminal system solving the aforementioned problems is desired.

SUMMARY

A variable air flow/multiple zone HVAC air terminal system includes a conditioned air passageway receiving air from a heat exchanger as conditioned air and a bypass air passageway receiving air substantially bypassing the heat exchanger as bypass air. A plurality of outlet air passageways provide air to a plurality of zones, at least a subset of which direct air to separate zones of a building. A corresponding plurality of rotating air dampeners selectively control air flow from the conditioned air passageway and the bypass air passageway to respective ones of the plurality of outlet air passageways. A plurality of damper drivers drive respective ones of the rotating air dampers. The damper drivers are capable of causing rotation of the rotating air dampeners in response to sensed air conditions in the respective zones. The air dampers control ratios and volume flow rates of the conditioned air and the bypass air fed to the respective outlet air passageways. A controller is responsive to sensed conditions in the respective zones to establish demands for the respective zones and to control the rotating air dampers according to the demands.

The air terminal may include an outside air passageway to receive air from a fresh air or outside air inlet. Demands established by the controller further comprise a requirement for fresh air in the respective zones.

The rotating air dampers may include a cylindrical damper can, with openings therein, such that rotation of respective ones of the rotating air dampers selectively varies air flow through the damper from the conditioned air and the bypass air to control the ratios and volume flow rates of the conditioned air and the bypass air fed to the respective outlet air passageways.

These and other features of the present disclosure will become readily apparent upon further review of the following specification and drawings.

BRIEF DESCRIPTION OF THE DRAWINGS

Similar reference characters denote corresponding features consistently throughout the attached drawings.

DETAILED DESCRIPTION OF THE PREFERRED EMBODIMENTS

A variable air flow/multiple zone HVAC air terminal system includes an HVAC air terminal device that combines the functions of individual zone level temperature and outside air ventilation control for multiple zones of a variable air flow volume (VAV) system into a single device. The combined functions improve efficiency of the HVAC systems by reducing the air delivery and reheat energy requirements. This also simplifies operation and maintenance of these systems by consolidating multiple zones into a single device and by reducing the per-zone control components associated with temperature and ventilation control. This reduces capital cost of the HVAC system and reduces the per zone manufacturing cost of VAV air terminal equipment.

The system is able to quantify zone demand for the areas served by these multiple zone air terminal units and utilizes that data to control system level set points for outside ventilation air supply temperature and humidity, as well as the operating set points for central cooling and heating plant operations. The disclosed technology may be utilized by building owners, architects, engineers, and the building contracting community for new construction, as well as for remodeling and renovation construction. The system can be installed in residential, commercial, institutional, educational, and industrial facilities.

The configuration, referenced as a variable air flow/multiple zone HVAC air terminal system, includes a multiple zone HVAC air distribution system level configuration and a multiple zone air terminal unit configuration utilizing a dual path control damper arrangement, as well as a three-path configuration that combines the dual path temperature and air volume control function with zone by zone ventilation control to supply precise ventilation air quantities by zone, and control algorithms that provide precise zone level heating, cooling, and ventilation air demand data for operating the outside ventilation air conditioning system and the cooling and heating plant systems.

Figure 1A:
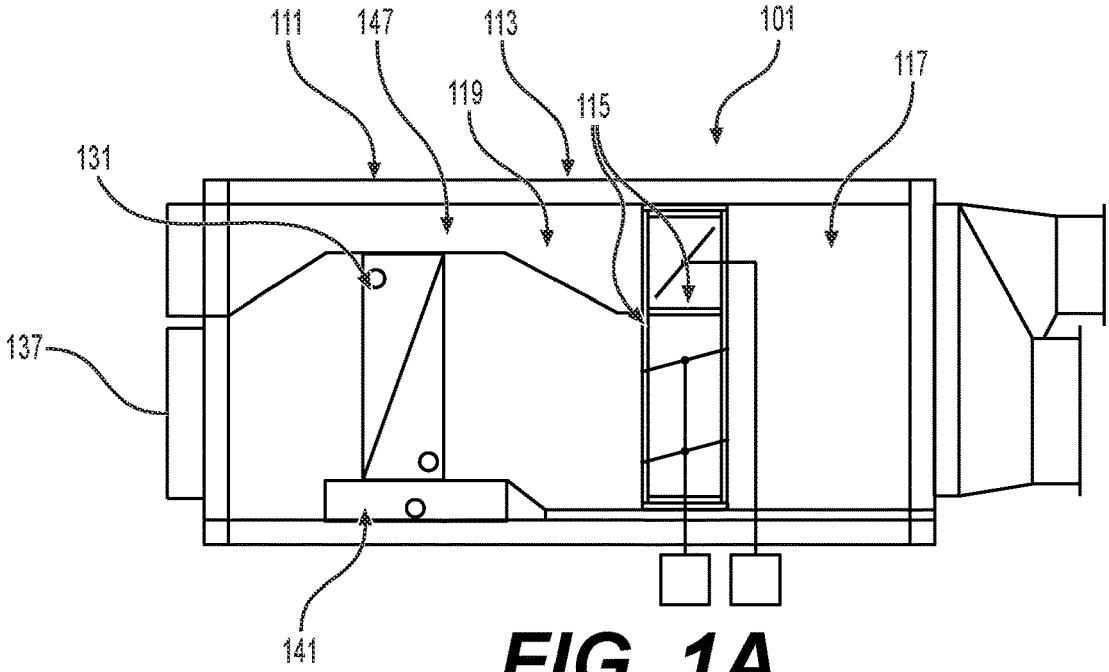
FIGS. 1A & 1B are schematic diagrams of a side-view and top view, respectively, of an exemplary air terminal for a variable air flow/multiple zone HVAC system.
Figure 1B:
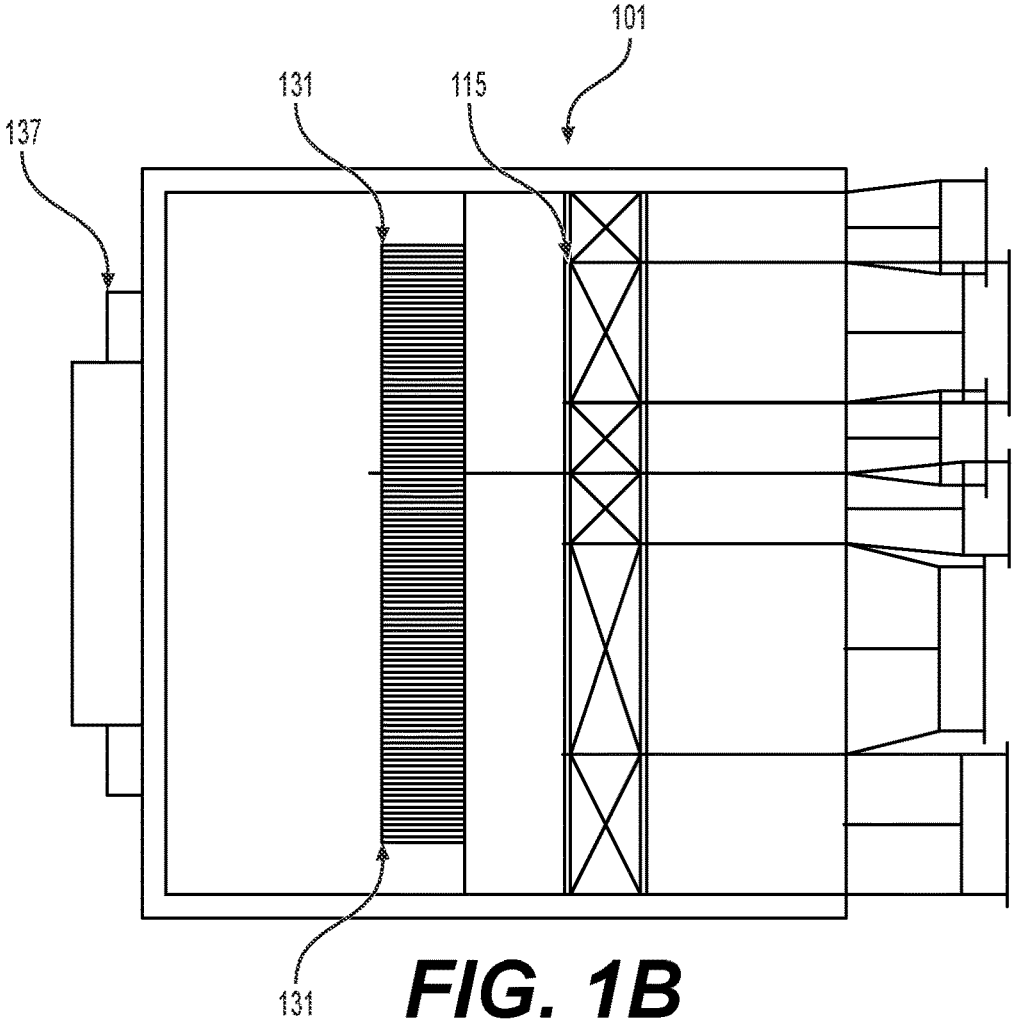

FIG. 1 is a schematic diagram of a basic HVAC air terminal device 101 constructed according to the present disclosure. The Figure shows a heat exchange and inlet air module 111, heat exchange output plenum section 113, damper segment 115, and damper outlet section 117. In the example, heat exchange and inlet air module 111 and heat exchange output plenum section 113 are provided with a bypass circuit 119.

Heat exchange and inlet air module 111 houses heat exchanger 131, which can be a single cooling/heating air coil or multiple heat exchange devices configured to provide cooling/heating function to a sub-set of zones having similar thermal requirements, e.g., interior zone sub-set coil could be cooling while the perimeter zone sub-set coil is heating. Heat exchange and inlet air module 111 also includes return air inlet 137, which is connected to a single blower (not shown) and a filter (not shown). Additional equipment, such as a humidifier, UV light or ionizing air treatment (not shown), can also be provided, as well as a condensate drain pan 141.

Heat exchanger bypass duct 147 allows filtered air from the blower to bypass heat exchanger 131 as part of bypass circuit 119. This allows the passing of air that is not temperature-conditioned to pass to damper segment 115. Thus, if temperature regulation is such that a portion of the building does not need temperature adjustment, bypass air can be provided. The ability to bypass or partially bypass air also allows, when desired, a larger volume of air to be selectively admitted to zones to increase or decrease air flow at different rates than warranted by temperature adjustment demands.

The bypass duct feature avoids the common inefficiency of VAV reheat control systems where the supply air must be modulated to a minimum reheat air volume (typically 30%) and then the cooled air is reheated to a point required to satisfy the zone heat loss. Typically, the VAV reheat control sequence will adjust the supply air temperature, for example, from a range of between 55° F.-60° F., but must then reheat the minimum airflow back up to 70° F.+, as required to maintain zone temperature set point. When the majority of zones are in the cooling mode, this approach still applies, but in reverse. In this case, the supply air temperature set point is decreased when the space is occupied, which increases the need to provide this type of control.

As will be described, the damper segment 115 incorporates dampers for multiple zones. Therefore, the output of the damper segment, viz., the heat exchange outlet plenum 113, is divided into multiple sections corresponding to the number of zones. It is also possible to configure the dampers and/or sections of the damper output section 117 so that multiple dampers and/or outlet sections supply one zone.

Figure 2A:
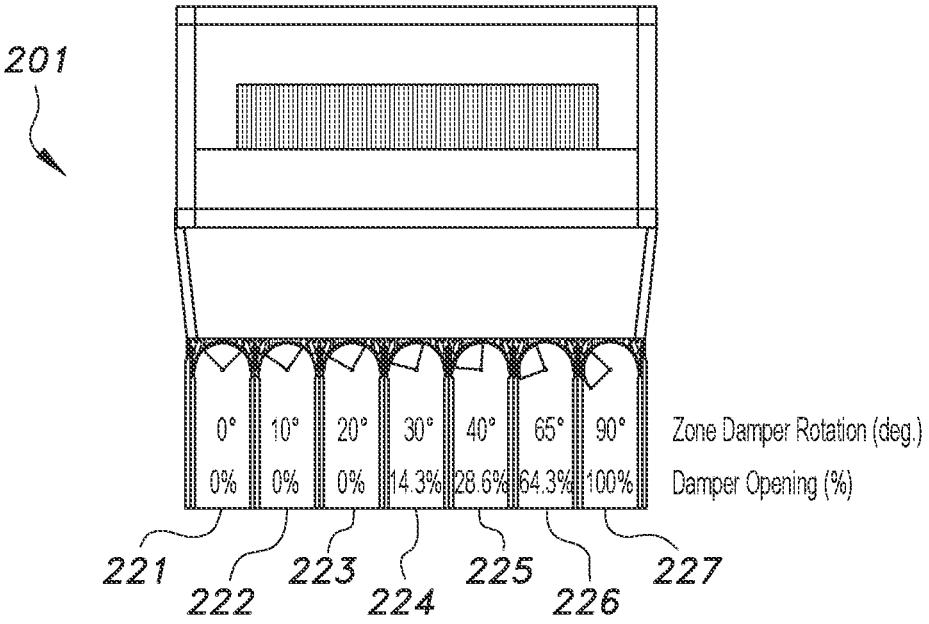
FIG. 2A is a schematic section view of a main damper for a variable air flow/multiple zone HVAC air terminal system.
Figure 2B:
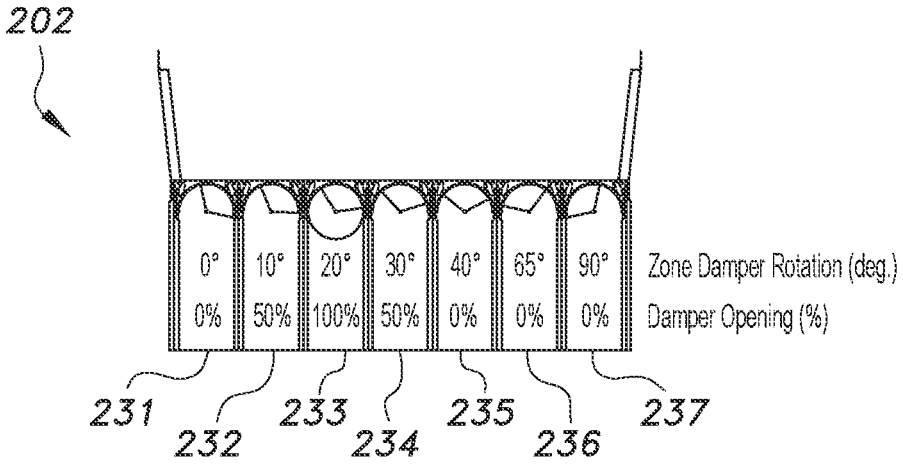
FIG. 2B is a schematic section view of a bypass damper for a variable air flow/multiple zone HVAC air terminal system.

FIGS. 2A and 2B are schematic diagrams showing a main damper bank 201 and a bypass damper bank 202, respectively. The main damper bank 201 has multiple dampers 221-227 providing controlled air output to corresponding multiple zones. Bypass damper bank 202 has multiple dampers 231-237 corresponding to the same set of multiple zones, so that the damper 221 and the damper 231 serve one zone, damper 221 and damper 232 serve a second zone, etc. As is apparent, main damper bank 201 receives air from heat exchanger 131 and bypass damper bank receives air from bypass circuit 119.

This damper assembly also includes a heat exchanger bypass function for each zone, the purpose of which is to allow a common airside heat exchanger, acting as the cooling/heating source for all zones it serves, to be in a single mode. If any given zone served by this heat exchanger has satisfied its set point, the bypass provision allows return air to be circulated to the zone to prevent overcooling or over heating of the zone when the zone is at or near the set point. For instance, if the majority of zones being served by this airside heat exchanger are calling for cooling air, yet a perimeter or unoccupied zone has drifted below set point, the damper assembly can bypass warmer return air around the airside heat exchanger to offset the heat loss for that zone.

When the system is in cooling and a zone being served falls below the heating set point due to an unoccupied state, or due to an exterior exposure, the previously satisfied zone damper moves off 0° rotation progressively to 20% open, allowing the warmer bypass air to supply the cooler zone. In case a zone being unoccupied and in case of exterior exposure, when ambient temperature is above or slightly below the zone's set point, the bypass air will nearly always be able to satisfy the zone's standby or unoccupied heating set point.

Dampers 221-227 and dampers 231-237 are separately adjustable, so any one zone can receive temperature-conditioned air and bypass air in amounts and proportions as selected. Heat exchange and bypass control of multiple damper segments serving one zone can be accomplished with a single actuator driving multiple dampers connected by a series of damper linkages or gears. The conditioned air damper and bypass air damper for a given zone could also be controlled independently by utilizing two actuators on a concentric shaft arrangement, which could afford a programmable range of adjustment on the conditioned/bypass air mixture ratios.

In one exemplary configuration, dampers 221-227 and dampers 231-237 may be rotating dampers, which are coaxially arranged for each zone. To accomplish a variable air flow volume operation of this arrangement would require offsetting the damper segments on a common shaft, which eliminates the requirement for individual damper actuators and additional I/O control points.

A significant aspect of this configuration is having the opening of the damper for the main supply air path from the heat exchanger delayed as the actuator rotates in the initial segment of the damper rotation. This allows recirculated air to the space without being impacted by the heat exchanger. As the damper actuator rotates further, the bypass damper begins to close, while the main damper begins to open to the heat exchanger. The bypass damper will modulate from closed to full flow from 0° to 20° and full flow to closed as the damper actuator rotates from 20° to 40°, and will remain closed for the balance of the damper actuator rotating range of 90°.

In one exemplary configuration, main damper bank 201 will open from 0% at 20° to 100% open at 90° rotation. The bypass segment full range is only within the first 40°, while the main segment has a range of 70°, in this example. The proportions are attributable to a requirement for bypass air volume not being equal to the main air volume. Additionally, a design pressure drop across the heat exchanger in the vicinity of 0.5" to 1.0" W.C., is expected, depending on design cooling requirements and if the coil is wet or dry. For most VAV reheat systems, the typical airflow minimum would be 30 to 50% of main air flow. Therefore, there is more static pressure available to the bypass damper segment that allows this air volume to be delivered through the reduced opening area.

While fully closed and fully open configurations are described, it is possible to limit the range of opening or closing of the dampers according to criteria known to HVAC design engineers and HVAC maintenance personnel.

Figure 3A:
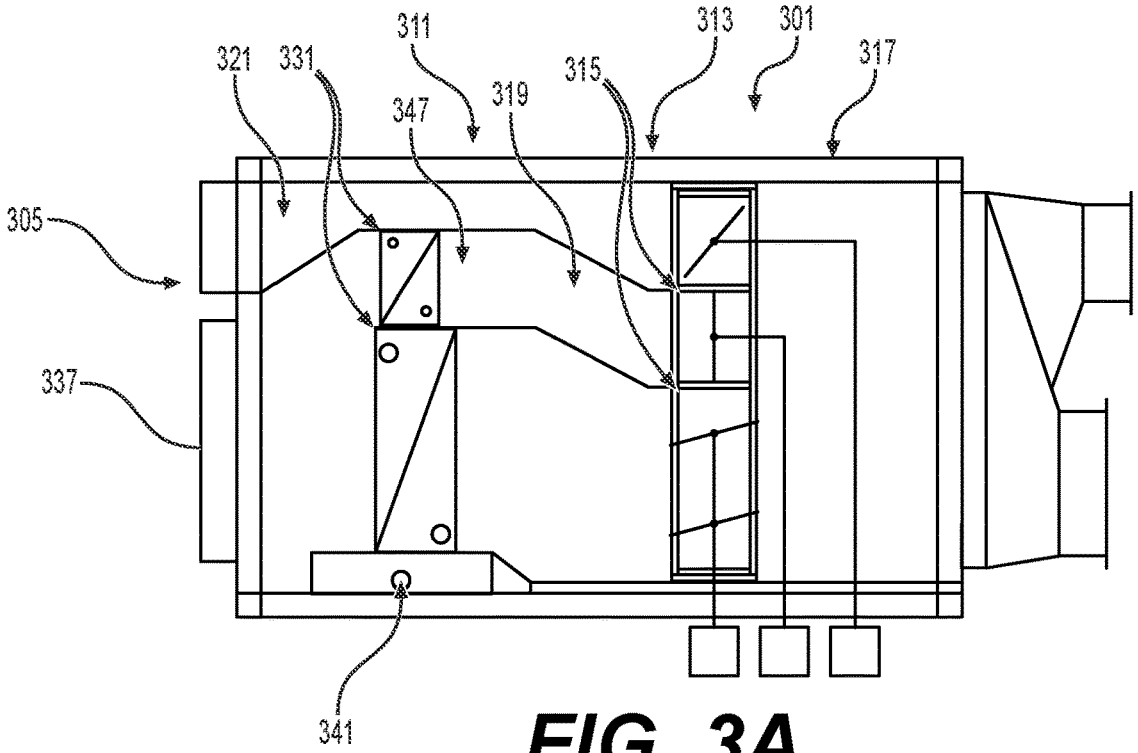
FIGS. 3A & 3B are schematic diagrams of a side-view and top view, respectively, of an exemplary air terminal with an outside air circuit for a variable air flow/multiple zone HVAC system.
Figure 3B:
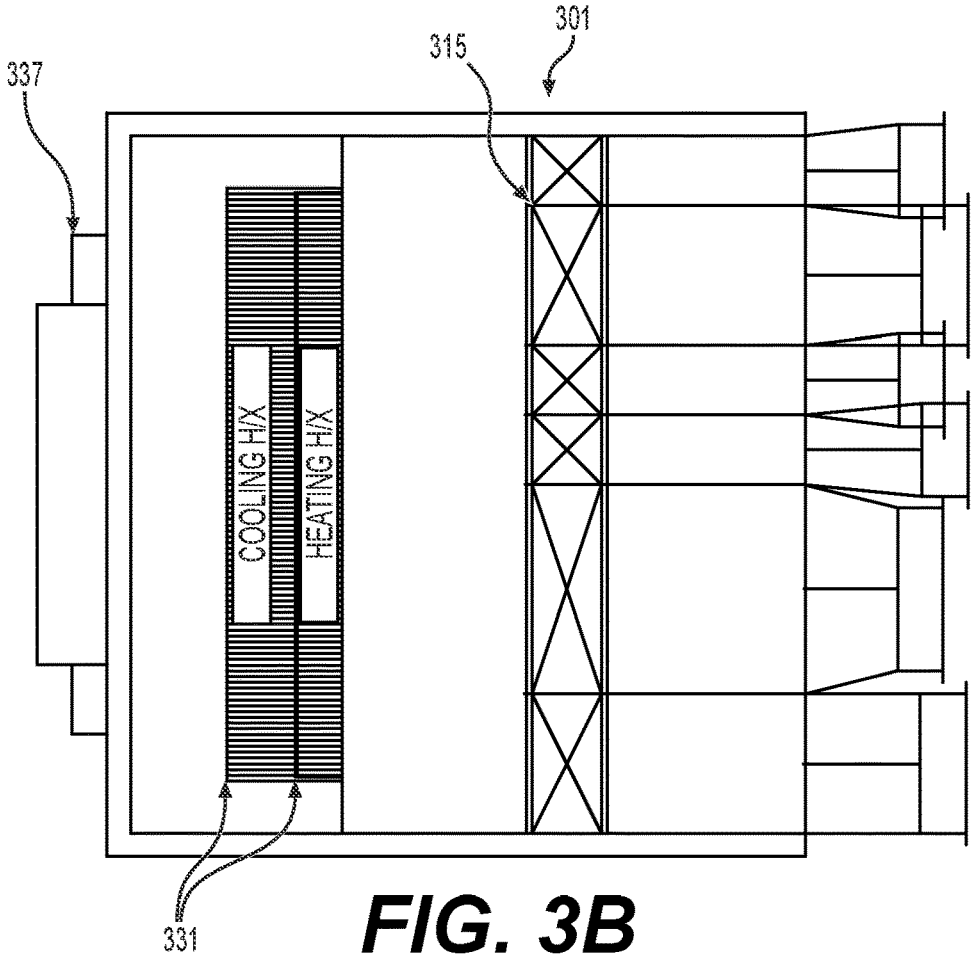

FIG. 3 is a schematic diagram of an HVAC air terminal device 301 with an outside air circuit 305 that is controllable on a per-zone basis. The Figure shows heat exchange and inlet air module 311, heat exchange output plenum section 313, damper segment 315, and damper outlet section 317. In the example, heat exchange and inlet air module 311 and heat exchange output plenum section 313 are provided with a bypass circuit 319.

Outside air circuit 305 includes filtered outside air inlet plenum 321, which can optionally be integrated with heat exchange and inlet air module 311. Filtered outside air inlet plenum 321 connects with damper section 315, which separately controls outside vent air to the respective zones.

As with the first configuration, heat exchange module and inlet air 311 houses heat exchanger 331. Heat exchange module also includes return air inlet 337, which is connected to a blower (not shown) and a filter (not shown). Filtered outside air inlet plenum 321 receives air from a separate blower and filter (not shown), which draws air from an outside inlet vent. As with the first configuration, additional equipment, such as a humidifier, UV light or ionizing air treatment (not shown) can also be provided, as well as condensate drain pan 341.

Heat exchanger bypass duct 347 allows filtered air from the blower to bypass heat exchanger 331 as part of bypass circuit 319. This allows the passing of air which is not temperature conditioned to pass to damper segment 315. Thus, if temperature regulation is such that a portion of the building does not need temperature adjustment, bypass air can be provided. The ability to bypass or partially bypass air also allows a larger volume of air to be selectively admitted to zones to increase or decrease air flow at different rates than warranted by temperature adjustment demands.

Outside air circuit 305 allows separately controlling a mixture of outside air for purposes of providing fresh air according to occupancy. Additionally, the outside air circuit 305 can provide an economizer function by admitting outside air for temperature control in appropriate circumstances.

Figure 4A:
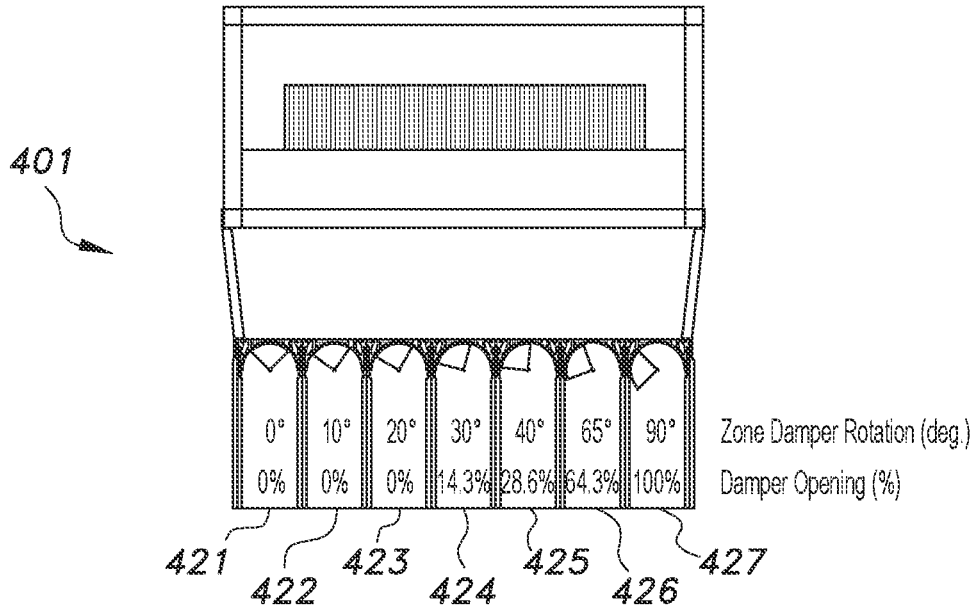
FIG. 4A is a schematic section view of a main damper for a variable air flow/multiple zone HVAC air terminal system having the air terminal of FIG. 3.
Figure 4B:
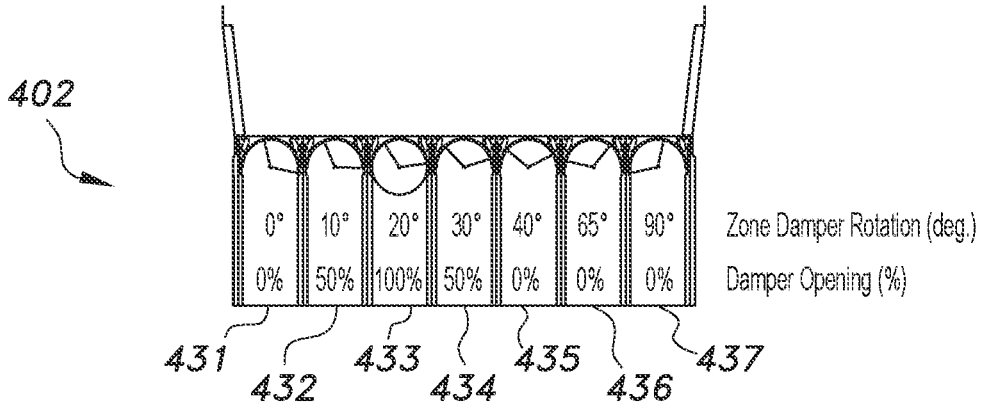
FIG. 4B is a schematic section view of a bypass damper for a variable air flow/multiple zone HVAC air terminal system having the air terminal of FIG. 3.
Figure 4C:
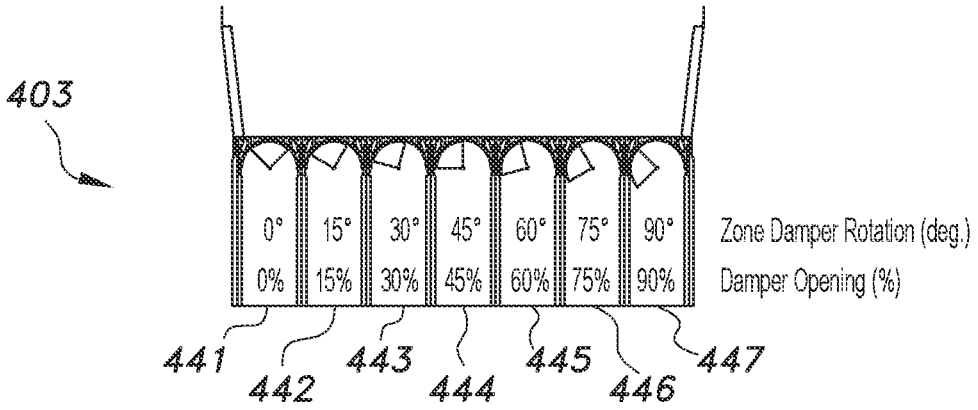
FIG. 4C is a schematic section view of an outside air damper for a variable air flow/multiple zone HVAC air terminal system having the air terminal of FIG. 3.

FIGS. 4A, 4B, and 4C are schematic diagrams showing a main damper bank 401, a bypass damper bank 402 and an outside air damper bank 403, respectively. Damper bank 401 and bypass damper bank 402 are similar to main damper bank 201 and a bypass damper bank 202 described in connection with FIGS. 2A and 2B and perform the same function. Outside air damper bank 403 is able to separately control outside air venting to the individual zones serviced by HVAC air terminal device 301.

Accordingly, main damper bank 401 and bypass damper bank 402 function as described in connection with dampers 201, 202 in the first configuration, that is, main damper bank 401 has multiple dampers 421-427, providing controlled air output to corresponding multiple zones. Bypass damper bank 402 has multiple dampers 431-437, corresponding to the same set of multiple zones.

The outside air damper bank 403 has multiple dampers 441 447, so that damper 421, damper 431 and damper 441 serve one zone; damper 421, damper 432 and damper 442 serve a second zone, etc. As is apparent, main damper bank 401 receives air from heat exchanger 331, bypass damper bank 402 receives air from bypass circuit 319, and outside air damper bank 403 receives air from filtered outside air inlet plenum 321.

In an exemplary configuration, dampers 421-427 and dampers 431-437 may be rotating dampers, which are coaxially arranged for each zone. To accomplish a variable air flow volume operation of this arrangement would require offsetting the damper segments on a common shaft, which eliminates the requirement for individual damper actuators and additional I/O control points for control of the conditioned and bypass segments. Dampers 441-447 for outside air damper bank 403 can be coaxially in-line with dampers 421-427 and dampers 431-437, or separately aligned.

Dampers 421-427, dampers 431-437, and dampers 441-447 are separately adjustable, so any one zone can receive temperature-conditioned air, bypass air, and filtered outside air in amounts and proportions as selected. This configuration is particularly useful in building environments in which room use varies. Examples would be a dining room or auditorium in a building in which occupancy is typically in other rooms, such as offices or classrooms. If one or more rooms is occupied by a significant number of people only on an occasional basis as compared to other areas of the building, providing ample outside air ventilation in the same proportion for each room, or according to the same time schedule for each room would be uneconomical. Thus, dampers 441-447 in outside air damper bank 403 would respond to room occupancy to vent outside air for the respective zones according to the instantaneous or current occupancy of the respective zones.

A significant feature of this component is a concentric damper shaft rotating the ventilation damper from within a hollow main/bypass damper shaft (or vice versa, depending on preferred location of the OA damper relative to the main/bypass damper assembly). This becomes practical as a result of the development of direct shaft coupled electronic actuators. With this configuration the two actuators can be mounted on the same side of the damper assembly, in a stacked or offset stack configuration. It may be particularly useful to have both actuators accessible from one side, e.g., the bottom, for service in above ceiling applications; the most likely configuration for institutional and commercial applications.

Figure 5:
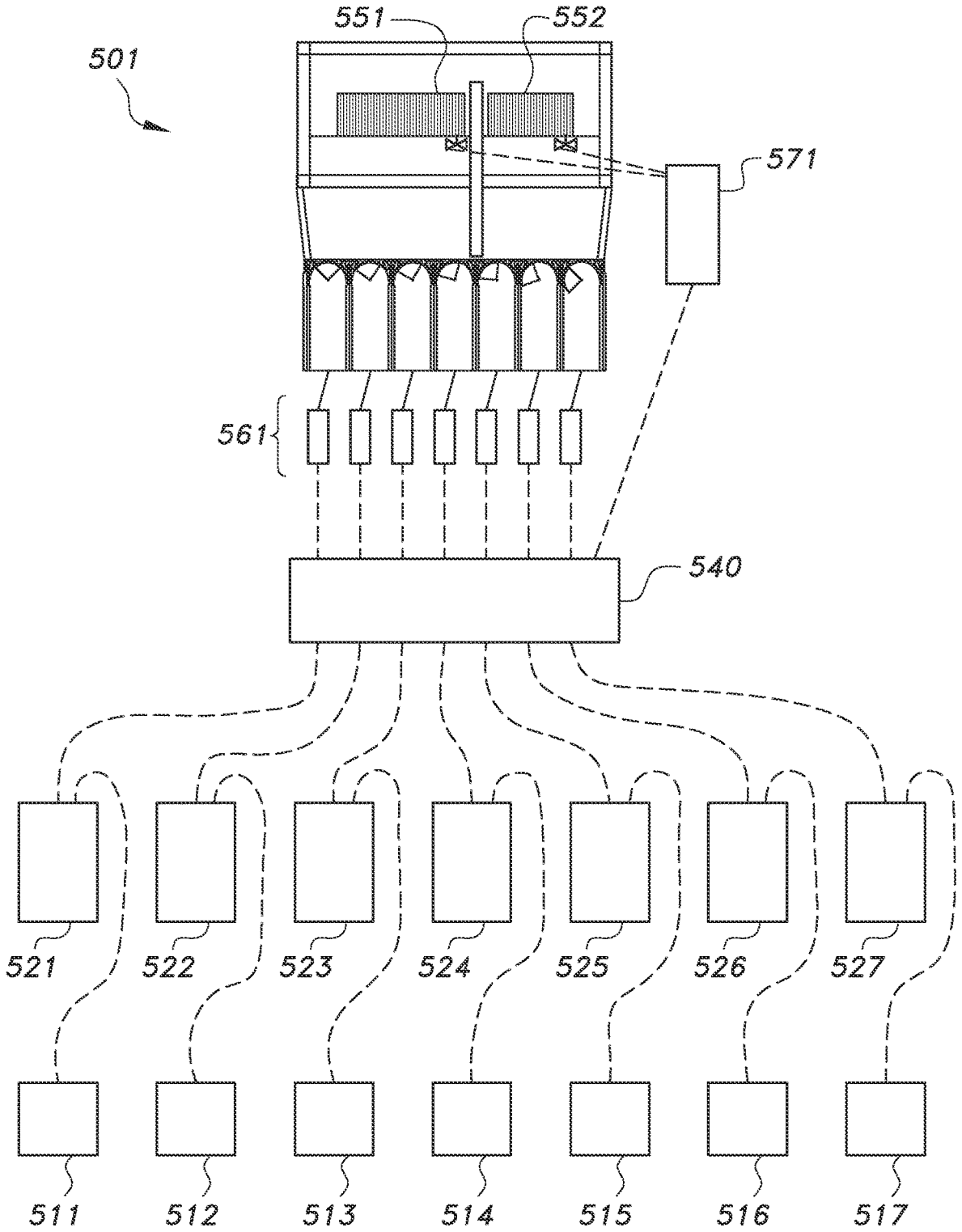
FIG. 5 is a schematic diagram showing a control system for the variable air flow/multiple zone HVAC air terminal system of FIGS. 3 and 4A-4C.

FIG. 5 is a schematic diagram showing a control system for the variable air flow/multiple zone HVAC air terminal system of FIGS. 3 and 4. The Figure shows the HVAC air terminal device 501 with temperature control drivers 511-517, outside air ventilation control drivers 521-527, and HVAC control module 540. Additionally, HVAC air terminal device 501 uses a split heat exchanger system, as will be described.

Temperature control drivers 511-517 and outside air ventilation control drivers 521-527 control dampers in main damper bank 401, bypass damper bank 402, and outside air damper bank 403. Temperature control drivers 511-517 provide room temperature control for the respective zones, and outside air ventilation control drivers 521-527 provide outside air ventilation control for the respective zones. HVAC control module 540 may comprise individual temperature sensors for each zone for temperature control and individual room occupancy sensors for each zone for outside air ventilation control, or can be controlled by a separate supervisory control and data acquisition (SCADA) module responsive to sensed temperature, humidity and occupancy.

In addition, humidity control, typically integrated with temperature control, is controlled by HVAC control module 540 in response to overall building humidity or humidity in the individual zones.

HVAC air terminal device 501 uses multiple heat exchangers 551, 552, and a divided flow to the dampers, which allows the system to provide different heating and/or cooling outlets for different ones of dampers 561. HVAC control module 540 controls heat exchange controller 571, which allows separate control of heat exchangers 551, 552. This arrangement allows the building to be divided according to anticipated heating and cooling requirements, as desired. For example, one heat exchanger 551 can supply temperature-conditioned air for outside rooms with windows, while the other heat exchanger 552 can supply temperature-conditioned air to inside rooms, allowing separate selection of heating and/or cooling for the divided building without requiring separate individual packaged HVAC terminal units for each individual zone. In an additional example, heat exchange controller 571 would allow a heat exchanger 551 configuration to supply cooling air to the conditioned air plenum and a heat exchanger 552 configured to supply heated bypass air to the bypass duct without requiring reheat of any conditioned air. This can also provide more efficient operation than afforded by either individual packaged HVAC terminal units for each zone or a common packaged HVAC terminal unit for all zones.

Temperature controls are well known. Occupancy level can be determined by occupancy sensors, discrete occupant count, or indirectly by monitoring $CO_2$ or other gas concentration levels, or by detection of other conditions related to occupancy. Occupancy sensing by monitoring $CO_2$ or other gas concentration has the advantage of detection of variable numbers of occupants according to air demand (based on the $CO_2$). Occupancy sensing can be as simple as light switch sensing or by sensors capable of responding to different levels of occupancy. By way of non-limiting examples, occupancy sensing can be accomplished by direct detection of occupants, such as by presence sensors, body heat sensors, ultrasonic sensing, time of flight infrared sensing, and people counter sensors. Occupancy sensing, as used herein, is also intended to include sensing of other indoor gases, such as from cooking and hygienic use of the spaces.

Additionally, if a SCADA technique is used, the blower and heat exchange functions can be adjusted according to overall system demands and sensed outside air temperature and moisture content. For single occupant zones the ventilation air set-point can be determined by an occupancy sensor. In this case, the outside air would be modulated to maintain design set-point. For multiple occupant zones, the ventilation set-point can be adjusted in response to a discrete occupant count or indirectly by monitoring $CO_2$ other gas concentration. In these cases, the SCADA can be used to adjust the set-point corresponding to occupancy levels of the zone.

The ability to selectively admit outside air is significant because this allows a single heat exchanger (indoor coil) to function with multiple zones, and further allows adjustment of outside air per zone without significantly changing the outside air flow for the overall system based on changes in a small proportion of the conditioned space. Correspondingly, this allows providing ample fresh air ventilation to zones that require significant amounts of fresh air (typically due to high occupancy), but without a requirement to figuratively "open the windows" in zones that have low occupancy. This allows selective fresh air ventilation on a per-zone basis and allows adjustment of heating or cooling per zone, while maintaining a single heat exchange and inlet air module 111 or 311 for multiple zones. The system also significantly reduces the energy consumed by the fan to deliver this minimum airflow and by the mechanical equipment in generating the cooling and heating energy.

Modern air conditioners and heat pumps use variable speed compressors in combination with adjustable expansion valves to conserve energy. This increase in efficiency occurs when the compression function is working at partial power, while modulating to match system demand. Therefore, if temperature conditioning can be shared between zones, it is possible to operate the heat pump function at partial power, even though one or more zones may be operating at full load. Furthermore, it becomes possible to transfer heat generated in cooling mode zones to zones concurrently in the heating mode.

To a lesser extent, it is possible to improve humidity control by enhanced dehumidification through the system during reduced air flow speed through the heat exchanger for cooling. In this manner, dehumidification rate can be increased by lower coil leaving air temperatures as air flow speed through the heat exchanger is reduced, while still allowing adjustments in air flow rates by means of adjustments in bypass air within the constraints of temperature regulation.

In the humidification mode, this is typically accomplished independently of the balance between the zones. Since the multiple zones have a common point of return, humidity across the different zones becomes more balanced.

Economizer sequences can be accommodated by the system. The use of economizing control modes is intended to take advantage of opportunities for utilizing cooler ambient conditions to provide cooling for buildings that are operating with internal cooling loads exceeding the systems ventilation and perimeter heat loss. Economizing can be accomplished by three techniques: airside economizing; waterside economizers; or load shedding economizers.

With airside economizing, outside and return air is mixed in proportions such that the resultant mixed air temperature is adequately low to cool the zone in whole or in part, without using mechanical refrigeration. With waterside economizers, the cooling media is cooled by ambient air such that central refrigeration loads are offset in whole or in part.

Load shedding economizers are used in conjunction with centralized heat recovery methods. Load shedding economizing is used in a manner such that the internal heat gains are only offset by economizing to the extent that they are balanced with the building's heat losses. This is particularly effective for buildings where internal heat gains far exceed perimeter skin losses.

While seven zones are shown in the examples provided above, the system can operate with fewer or more zones, depending on design choice. The total number of zones is determined by the practicalities of providing common blowers and heat exchangers for multiple zones and the need to feed air ducts from the air terminal to the different zones. As with other air distribution systems, it is also possible to incorporate other components, such as in-duct blowers, high efficiency filtration, tempering coils and conditioners.

It is to be understood that the variable air flow/multiple zone HVAC air terminal system is not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

What is claimed is:

1. An air handler for a variable air flow/multiple zone HVAC system, comprising:

a conditioned air passageway receiving air from a heat exchanger as conditioned air;

a bypass air passageway for receiving air substantially bypassing the heat exchanger as bypass air;

a plurality of outlet air passageways providing air to a plurality of zones, at least a subset of the outlet passageways directing air to separate zones of a building;

a plurality of rotating air dampers selectively controlling air flow from the conditioned air passageway and the bypass air passageway to respective ones of the plurality of outlet air passageways;

a plurality of damper drivers driving respective ones of the rotating air dampers, the damper drivers being capable of causing rotation of the rotating air dampers responsive to sensed air conditions in the respective zones to control ratios and volume flow rates of the conditioned air and the bypass air fed to the respective outlet air passageways; and a controller responsive to sensed conditions in the respective zones to establish demands for the respective zones and control the rotating air dampers and heat exchangers according to the demands.

2. The air handler of claim 1, further comprising a plurality of valve assemblies associated with said plurality of rotating air dampers respectively serving the plurality of zones, each of said valve assemblies including:

a first inlet capable of receiving conditioned air;

a second inlet capable of receiving bypass air; and an outlet.

3. The air handler of claim 1, further comprising an outside air passageway receiving air from a fresh air or outside air inlet, the demands established by the controller including a requirement for fresh air in the respective zones.

4. The air handler of claim 3, further comprising: an occupancy sensing device in at least one of the zones indicating occupancy in the at least one of the zones, the controller receiving signals from the occupancy sensing device to establish demand for fresh air in the at least one of the zones, the outside air passageway receiving air from a fresh air or outside air inlet, the demands established by the controller including said requirement for fresh air in the at least one of the zones.

5. The air handler of claim 3, further comprising:

an occupancy sensing device in at least a subset of the zones indicating occupancy in the subset of the zones, the controller receiving signals from the occupancy sensing device to establish demand for fresh air in the respective ones of the subset of the zones; and an outside air passageway for the subset of the zones, the outside air passageway receiving air from a fresh air or outside air inlet; the demands established by the controller including said requirement for fresh air in the respective ones of the subset of the zones.

6. The air handler of claim 1, wherein the rotating air dampers each comprise a cylindrical damper can having openings defined therein, such that rotation of the respective ones of the rotating air dampers selectively varies air flow through the damper from the conditioned air and the bypass air to control ratios and volume flow rates of the conditioned air and the bypass air fed to the respective outlet air passageways.

7. The air handler of claim 1, further comprising:

a control unit, separate and distinct for said controller, and responsive to a sensed air condition for controlling operation of the air dampers and associated heat exchangers.

8. The air handler of claim 1, wherein the heat exchanger comprises at least two heat exchange sub-sections, each of the sub-sections having air directed to different subsets of the plurality of rotating air dampers.

* * * * *